US006539860B2

(12) United States Patent
Tsunashima et al.

(10) Patent No.: US 6,539,860 B2
(45) Date of Patent: Apr. 1, 2003

(54) SYNCHRONOUS CONTROL SYSTEM FOR ROTARY PRESSES

(75) Inventors: Makoto Tsunashima, Kawasaki (JP); Hideo Kawamori, Mitaka (JP)

(73) Assignee: Tokyo Kikai Seisakusho, Ltd. (JP)

( * ) Notice: Subject to any disclaimer, the term of this patent is extended or adjusted under 35 U.S.C. 154(b) by 134 days.

(21) Appl. No.: 09/841,530

(22) Filed: Apr. 24, 2001

(65) Prior Publication Data

US 2002/0029705 A1 Mar. 14, 2002

(30) Foreign Application Priority Data

Apr. 28, 2000 (JP) ..... 2000-128725

(51) Int. Cl.[7] ..... B41F 5/16

(52) U.S. Cl. ..... 101/181; 400/582; 400/62; 400/67; 400/76

(58) Field of Search ..... 101/181, 183, 101/216, 248, 484; 318/700, 715, 85; 400/582, 76, 62, 67

(56) References Cited

U.S. PATENT DOCUMENTS

| | | | | |
|---|---|---|---|---|
| 5,263,413 A | * | 11/1993 | Ikeguchi | 101/183 |
| 5,309,834 A | * | 5/1994 | Koch | 101/248 |
| 6,343,549 B1 | * | 2/2002 | Tokiwa | 101/248 |
| 6,354,214 B1 | * | 3/2002 | Tokiwa | 101/484 |

FOREIGN PATENT DOCUMENTS

| | | | | |
|---|---|---|---|---|
| EP | 1167035 A2 | * | 1/2002 | B41F/33/00 |
| JP | 10-032992 | * | 2/1998 | H02P/5/52 |
| JP | 2964238 | | 8/1999 | |
| JP | 11-254637 | * | 9/1999 | B41F/7/02 |

* cited by examiner

*Primary Examiner*—Andrew H. Hirshfeld
*Assistant Examiner*—Darius N. Cone
(74) *Attorney, Agent, or Firm*—McGlew and Tuttle, P.C.

(57) ABSTRACT

In a rotary press intended to perform the synchronous control of driving means with high precision, quickly stabilize rotation, and reduce spoilage caused by phase shifts, comprising a plurality of printing mechanisms in which driving means M rotate N turns while plate cylinders P rotate one turn, so that printing images can be printed on a paper web sequentially passing through each printing mechanism in such a manner that the printing images are matched with a predetermined reference, in which a control section 3 replaces the rotational phase of the plate cylinder with the rotational phase of the driving means M corresponding to that rotational phase so as to match the printing images with a predetermined reference, converts a shift between the rotational phase of the driving means M for matching and the rotational phase of the driving means M in a normal state into the number of outputs of the first pulse signals, set it as a correction value, and obtains a virtual feedback value by shifting the rotational phase of the driving means M by the amount of the correction value, so that control is accomplished by synchronizing the driving reference phase with the virtual feedback phase of the driving means M.

14 Claims, 6 Drawing Sheets

SYNCHRONOUS CONTROL SYSTEM FOR ROTARY PRESSES

FIELD OF THE INVENTION

The present invention relates generally to a synchronous control system of rotary presses, and more particularly to a synchronous control system of rotary presses comprising a plurality of printing mechanisms driven individually by separate driving means that rotate N turns (N is a natural number) as a plate cylinder rotates one turn, a control section for controlling each driving means, so that printing images are matched with each other and printed on a paper web sequentially passing through each printing mechanism.

BACKGROUND OF THE INVENTION

Synchronous control systems for rotary presses of a type comprising a plurality of printing mechanisms driven individually by separate driving means, a control section for controlling each driving means, so that printing images are matched with each other and printed on a paper web sequentially passing through the printing mechanisms are disclosed in Japanese Published Unexamined Patent Application No. Hei-10(1998)-32992 and Japanese Patent Publication No. 2964238, for example.

The synchronous control system for rotary presses disclosed in Japanese Published Unexamined Patent Application No. Hei-10(1998)-32992 accomplishes synchronous control of rotary presses by monitoring changes in the phase difference between the master shaft mechanical movement and the slave shaft mechanical movement, that is, changes in the distance (phase difference) between the Z-phase signal of a master-side rotary encoder with Z phase connected to a master-shaft driving motor for driving a master-shaft mechanical movement and the Z-phase signal of a slave-side rotary encoder with Z phase connected to a slave-shaft motor for driving a slave-shaft mechanical movement, so that when the phase difference is changed, the slave-shaft driving motors are controlled to correct the change in the phase difference.

The synchronous control system for rotary presses disclosed in Japanese Patent Publication No. 2964238 controls motors for driving driven cylinders by providing phase signal output means to a reference cylinder, and driven cylinders, such as a plate cylinder and a blanket cylinder, each driven by different motors, causing the driving motors for the reference and driven cylinders to operate based on a speed instruction output by a speed command center, outputting a phase-difference signal by processing a signal from the phase signal output means for the reference cylinder and a signal from the phase signal output means for the driven cylinders, both being outputs as the result of the operation of the driving motors, and correcting the speed instruction to the driving motors for the driven cylinders based on the phase-difference signal.

The aforementioned prior-art synchronous control systems have the following problems.

That disclosed in Japanese Published Unexamined Patent Application No. Hei-10(1998)-32992 monitors the phase difference between the driving motors, and corrects the phase difference between the driving motors by regarding the change in the phase difference as the change in the phase difference between the mechanical movements driven by the driving motors. Consequently, it is effective so long as the rotation of driving motors agrees with the rotation of the mechanical movements, that is, the mechanical movements rotate one turn as the driving motors rotate one turn. However, when the rotations of the driving motors and the mechanical movements do not agree with each other, that is, when the mechanical movements rotate only ½ turns or ⅓ turns as the driving motors rotate one turn, the rotational phase of the mechanical movements would remain shifted by ½ or ⅓ turns, the phase shift could not be eliminated unless the entire system is started after the rotational phase of the mechanical movements is corrected to an almost proper phase. For this reason, this synchronous control system has not been put into practical use for rotary presses where the rotation of the mechanical movements is not in a one-for-one relation with that of the driving motors (driving means).

That disclosed in Japanese Patent Publication No. 2964238, on the other hand, obtains a phase difference between both cylinders by processing the phase signal of a reference cylinder and the phase signals of other driven cylinders, and corrects the phase difference by changing the rotational phase of motors for driving the other driven cylinders on the basis of the phase difference. Consequently, the synchronous control system disclosed in Japanese Patent Publication No. 2964238 has no such problems as experienced in that disclosed in Japanese Published Unexamined Patent Application No. Hei-10(1998)-32992. The synchronous control system disclosed in Japanese Patent Publication No. Hei-10(1998)-32992, however, uses transmission mechanisms not only between the reference cylinder and the motor for driving it, but also between the other driven cylinders and the motors for driving them. The "play," such as backlash, inherent in these transmission mechanisms tends to allow errors to creep into any of the phase signals of the reference cylinder and the other driven cylinders, making the signals unstable and inaccurate. Generating control signals for the driving motors by processing such phase signals may result in unstable control signals, making the control of the driving motors unstable and inaccurate. Thus, it has taken long time before the phase becomes stable at proper levels. For this reason, the conventional controlling method of plate cylinder rotation in rotary presses has often caused defective printing (spoilage) due to phase shifts before the phase becomes stable. From the foregoing, it may be appreciated that a need has arisen for countermeasures to cope with these problems.

SUMMARY OF THE INVENTION

The present invention has been conceived in view of the aforementioned problems. It is an object of the present invention to provide a synchronous control of rotary presses that can be applied to printing mechanisms having plate cylinders rotating 1/N (N being a natural number) turns for one turn of driving means, can control the driving means quite accurately, and can stabilize rotation quickly, accordingly stabilizing the rotation of the plate cylinders and reducing spoilage due to phase shifts.

It is a more specific object of the present invention to provide a synchronous control system for rotary presses where the rotation of plate cylinders is synchronized by using a plate cylinder signal generated for one turn of the plate cylinders, a first pulse signal output in proportion to the amount of angular displacement along with the rotation of the driving means, and a second pulse signal output for one turn of the driving means, setting in advance a driving reference comprising a reference speed and a reference phase, replacing the rotational phase of the plate cylinders for matching printing images with a predetermined reference with a rotational phase of the driving means corresponding to the aforementioned rotational phase, converting a shift between the driving means rotational phase for matching printing images with a predetermined reference and the driving means rotational phase in the normal state into the number of outputs of the first pulse signals, which is set as a correction value, producing a virtual feedback phase by shifting the driving means rotational phase by the amount of the correction value, and controlling so as to synchronize the driving reference phase with the virtual feedback phase of each driving means.

It is another object of the present invention to provide a synchronous control system for rotary presses where a plate cylinder signal output for one turn of the plate cylinders, a first pulse signal generated in proportion to the amount of angular displacement in accordance with the rotation of the driving means, a second pulse signal output for one turn of the driving means, and a driving reference comprising a driving reference speed and a driving reference phase based on a third pulse signal and a fourth pulse signal are set, the output timing of the fourth pulse signal with respect to the third pulse signal is set equal to the output timing of the second pulse signal with respect to the first pulse signal; a phase correction value for correcting a feedback phase, a driving reference speed signal and a driving reference phase signal based on the aforementioned driving reference, a feedback speed signal of the driving means based on the first pulse signal, and a virtual feedback rotational phase signal obtained by correcting by the amount of the aforementioned phase correction value the driving means feedback phase based on the first pulse signal, the second pulse signal and the plate cylinder signal are provided; and a control signal is output by correcting the drive reference speed signal with a signal relating to the difference between the drive reference phase and the virtual feedback rotational phase and the feedback speed signal, so that the operation of printing mechanisms can be controlled with the control signal.

It is still another object of the present invention to provide a synchronous control system for rotary presses where the synchronous control of a rotary press is accomplished by setting a plate cylinder signal output for one turn of the plate cylinders, a first pulse signal generated in proportion to the amount of angular displacement in accordance with the rotation of the driving means, and a second pulse signal generated for one turn of the driving means, and a driving reference comprising a driving reference speed and a driving reference phase, setting the output timing of the fourth pulse signal with respect to the third pulse signal equal to the output timing of the second pulse signal with respect to the first pulse signal, generating a drive reference speed signal based on the driving reference, a driving reference phase signal based on the driving reference, a feedback speed signal of the driving means based on the first pulse signal, a phase correction signal for correcting the driving means feedback phase of the driving means based on the first pulse signal, the second pulse signal and the plate cylinder signal, a virtual feedback phase signal obtained by correcting the feedback phase with the phase correction signal, a phase difference between the driving reference phase signal and the virtual feedback phase signal, a corrected control signal obtained by correcting the driving reference speed signal based on the outputs of the phase difference signal and the feedback speed signal, and controlling the driving means of the printing mechanisms using the corrected control signal via a motor driver.

The operation of the present invention is such that the rotational phase of plate cylinders for matching printing images with a predetermined reference is replaced with the driving means rotational phase corresponding to the rotational phase, and a difference between the driving means rotational phase for matching printing images with a predetermined reference and the driving means rotational phase in the normal state, that is, a difference in the amount of rotation of driving means is converted into the number of outputs of the first pulse signals that is set as a correction value.

In this state, a driving reference setting section is operated to output a driving reference comprising a driving reference speed and a driving reference phase. With this, each driving means begins rotation at the reference speed.

As each driving means rotates, a feedback signal output section generates a first pulse signal proportional to the amount of angular displacement of the driving means and a second pulse signal for one turn of the driving means, the plate cylinders are caused to rotate by the driving means, and a plate cylinder signal output section generates a plate cylinder signal for one turn of the plate cylinders.

In a control section, a virtual feedback phase is produced by shifting the rotational phase of each driving means by the amount of the correction value based on the first pulse signal, the second pulse signal and the plate cylinder signal, and control is accomplished so as to synchronize the driving reference phase and the virtual feedback phase of each driving means to synchronize the rotation of each plate cylinder.

This arrangement can prevent the phase from shifting at the start of control of plate cylinders based on the difference caused by the rotation by N turns of the driving means for one turn of the plate cylinders, making it possible to achieve synchronous control of the driving means with high accuracy. This arrangement also enables to quickly stabilize the rotation of the driving means. Furthermore, all these effects work synergistically in stabilizing the rotation of the plate cylinders and reducing spoilage, such as defective printing, due to shifts in the rotational phase of the plate cylinders.

DETAILED DESCRIPTION OF PREFERRED EMBODIMENTS

Now, embodiments of the present invention will be described in reference to the accompanying drawings.

Symbol M shown in the figures denotes a driving means, GT a transmission means, PC a plate cylinder, numeral 1 a master control section, 3 a control section (slave control section), 5 a network line, 6 a feedback signal output section (encoder), 7 a plate cylinder signal output section, 13 a driving reference setting section, 31 a driving reference receiving section (slave network connecting section), 32 a driving reference speed signal output section, 33 a driving reference phase signal output section, 34 a phase difference detecting section, 35 a phase difference signal output section, 36 a signal correcting section (first speed signal correcting section), 37 a virtual feedback phase signal output section, 38 a feedback signal receiving section, 39 a feedback speed signal output section, 40 a signal correcting section (second speed signal correcting section), 41 a motor driver, 42 a phase correction value output section, and 43 a phase correction signal output section.

(1) Construction of Rotary Press

Figure 1:
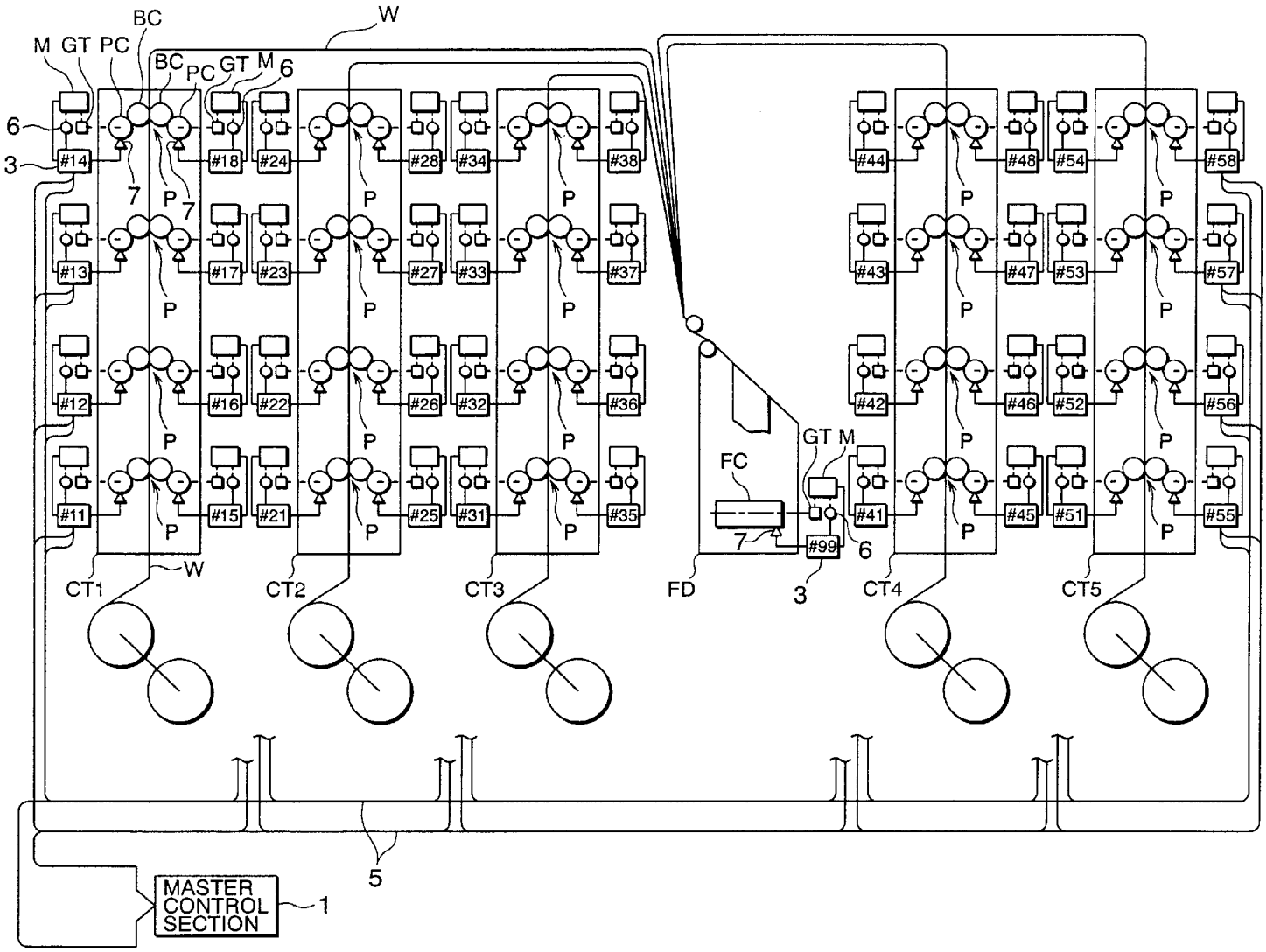
FIG. 1 is a diagram of assistance in explaining a rotary press embodying the present invention.

FIG. 1 is a diagram of assistance in explaining a rotary press in an embodiment of the present invention. In FIG. 1 shown is a synchronous control system for rotary presses embodying the present invention which is applied to a rotary press comprising printing units CT1, CT2, CT3, CT4 and CT5 each having four printing sections P, and a folding unit FD for cutting and folding a printed paper web into predetermined printing images.

The printing sections P for the printing units CT1, CT2, CT3, CT4 and CT5 have two sets each of printing couples comprising a blanket cylinder BC and a plate cylinder PC.

The printing couple is driven by a driving means M; the plate cylinder PC thereof being driven via a transmission means GT, and the blanket cylinder BC thereof via the plate cylinder PC and a transmission means (not shown) provided between the plate cylinder PC and the blanket cylinder BC in such a manner that the printing couple rotates 1/Np turns (Np being a natural number) for one turn of the driving means M.

That is, each of the printing units CT1, CT2, CT3, CT4 and CT5 is driven by independent driving means M. The folding unit FD is driven by the driving means M; the folding cylinder FC thereof being driven via the transmission means GT and the other cylinders thereof via a transmission means (not shown) provided between the folding cylinder FC and the other cylinders in such a manner that the folding unit FD rotates 1/Np turns (Np being a natural number) for one turn of the driving means M.

The driving means M has a rotary encoder (an incremental encoder; hereinafter referred to as an encoder) that is a feedback signal output section for generating not only first pulse signals (hereinafter referred to as pulse signals) of a quantity proportional to the amount of rotational angular displacement of the driving means M and the slave control sections 3 (#11~#18, #21~#28, #31~#38, #41~#48, and #51~#58) corresponding to each driving means M, but also second pulse signals (hereinafter referred to Z-phase pulse signals) for one turn of the driving means M. The slave control sections 3 are connected to a network line 5 via slave network connecting sections 31, which will be described with reference to FIG. 3. (The connecting manner of the slave control sections 3 (#15~#18, #21~#28, #31~#38, #41~#48, #51~#54, and #99) with the network line 5, which is the same as that of the slave control sections 3 (#11~#14, #55~#58), is not shown in the figure). Furthermore, a master control section 1 is connected to the network line 5.

In addition to the above construction, there can be another construction where the master control section 1 is replaced with a plurality of master control sections which have the function of the master control section, as will be described later, and can be selectively changed over.

The plate cylinder PC, on the other hand, has a part being inspected (not shown) that moves toward a predetermined position for each turn of the plate cylinder PC, and a proximity switch that is a plate cylinder signal output section 7 for detecting the approach of the part being inspected as it approaches the predetermined position. As a result, the plate cylinder signal output section 7 outputs a detection signal (hereinafter referred to as a plate cylinder signal) when it detects the arrival of th e part being inspected at the predetermined position.

The network line 5 is formed into a loop so that when any one thereof fails for some reason or other, the other thereof can be used to transmit signals between the master control section 1 and the slave control sections 3 (#11~#18, #21~28, #31~#38, #41~#48, #51~#58, and #99).

(2) Master Control Section

Figure 2:
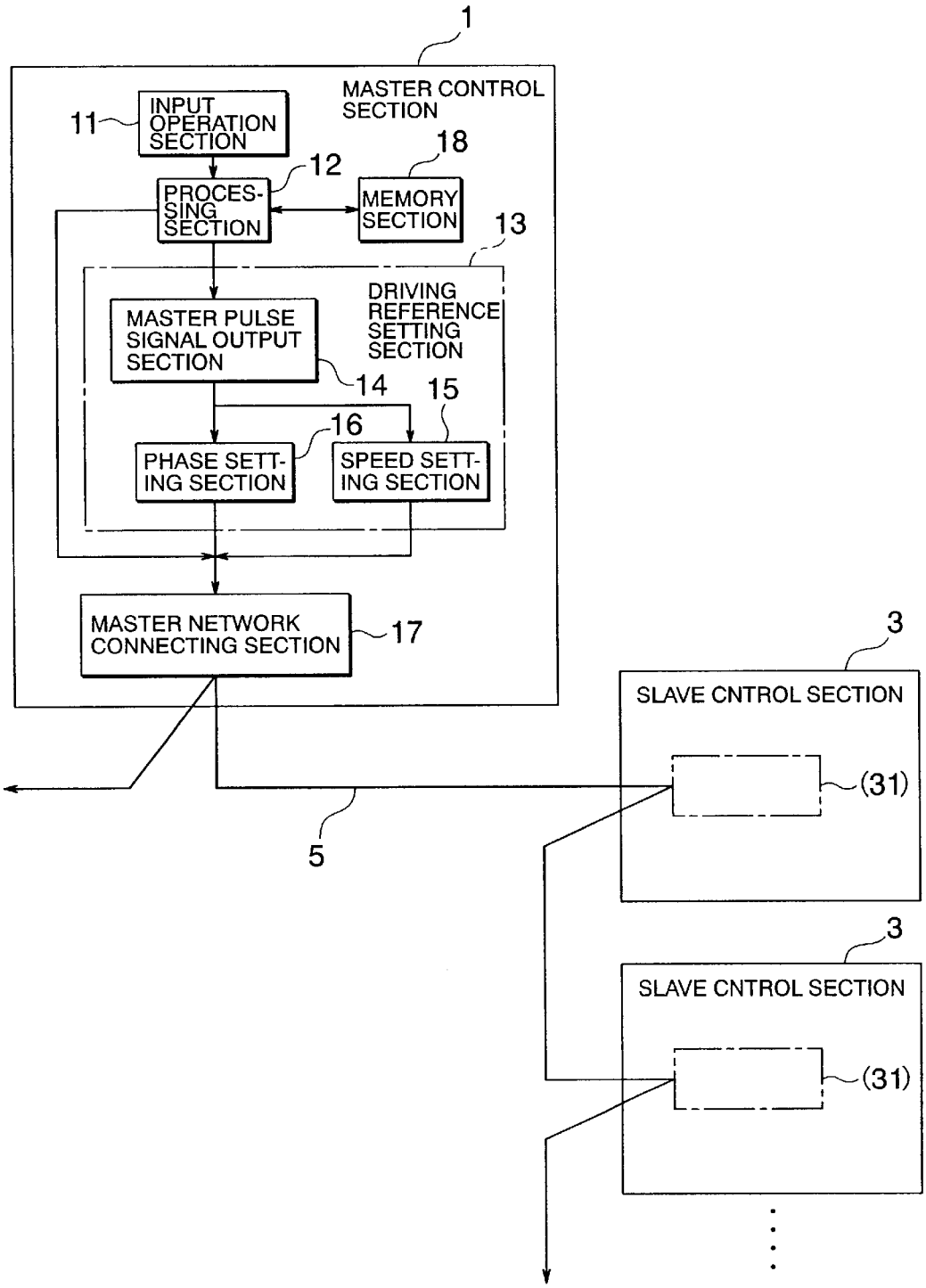
FIG. 2 is a diagram of assistance in explaining a master control section embodying the present invention.

FIG. 2 is a diagram of assistance in explaining the master control section. In FIG. 2, the master control section 1 has an input operation section 11, a driving reference setting section 13, a processing section 12, a master network connecting section 17, and a memory section 18. The driving reference setting section 13 has a master pulse signal output section 14, a speed setting section 15, and a phase setting section 16.

The input operation section 11 can replace the rotational phase of the plate cylinder for matching a printing image with a predetermined reference with the rotational phase of the driving means corresponding to this rotational phase, input into the memory section 18 a value (hereinafter referred to as a phase correction value) obtained by converting a shift between the replaced driving means rotational phase for matching and the driving means rotational phase in the normal state, that is, the difference in the amount of rotation of the driving means into the number of outputs of the first pulse signals, perform initial operations for inputting set organization information, such as designating printing units to be used for printing operation from among the printing units of CT1, CT2, CT3, CT4 and CT5, and specific operations for inputting operation signals, such as start, acceleration/deceleration, and stop.

The memory section 18 stores phase correction values entered by the input operation section 11. The driving reference setting section 13 sets a driving reference values for controlling the driving means M.

The processing section 12 prepares control range designation messages and other messages by organizing sets of rotary presses based on the set organization information entered by the input operation section 11, and enables specific operations from the input operation section 11 and driving reference setting based on these specific operations, so that the organized sets can be synchronously controlled. It also carries out other processes such as reading phase correction values from the memory section 18.

The master network connecting section 17 sends control range designation messages prepared by the processing section 12 to the network line 5, while sending to the network line 5 control messages relating to the phase correction value read out of the memory section 18 by the processing section 12, and the driving reference set by the driving reference setting section 13, and receives response messages on the response information sent by the slave control sections 3 via the network line 5.

The master pulse signal output section 14 outputs a third pulse signal (hereinafter referred to as a first master pulse signal) proportional to a speed value set by the processing section 12 based on the specific operation signals, such as start, acceleration/deceleration, and stop, input by the input operation section 11, and also outputs a fourth pulse signal (hereinafter referred to as a second master pulse signal) every time a predetermined number of first master pulse signals are generated. The first and second master pulse signals are signals having a frequency equal to the pulse signal generated by the encoder 6 provided corresponding to each driving means M and the Z-phase pulse signal generated by the encoder 6, when the printing units are operated at a set speed.

The speed setting section 15 sets the driving reference speed of the driving means M based on the first master pulse signal generated by the master pulse signal output section 14.

The phase setting section 16 sets the driving reference phase of the driving means M based on the first and second master pulse signals generated by the master pulse signal output section 14.

In addition to the above construction, there can be a construction where the master control section 1 comprises an input operation section for inputting initial operations for inputting set organization information and specific operation signals, such as start, acceleration/deceleration, stop, a processing section for setting a speed value based on the specific operation signal, and a master pulse signal output section for outputting a first master pulse signal proportional to the speed value, and outputting a second master pulse signal every time a predetermined number of the first master pulse signals are output; with the other component elements incorporated in slave control sections, which will be described later. In this construction, set organization information may be entered from the input operation section directly into each slave control section included in the set.

The master control section 1 may be such a simplified construction that the printing units and slave control sections have oscillators for transmitting synchronizing clocks. In short, it may be sufficient for the purpose that the master control section 1 is capable of transmitting signals enough for each printing unit to be synchronously controlled by each slave control section.

(3) Slave Control Section

Figure 3:
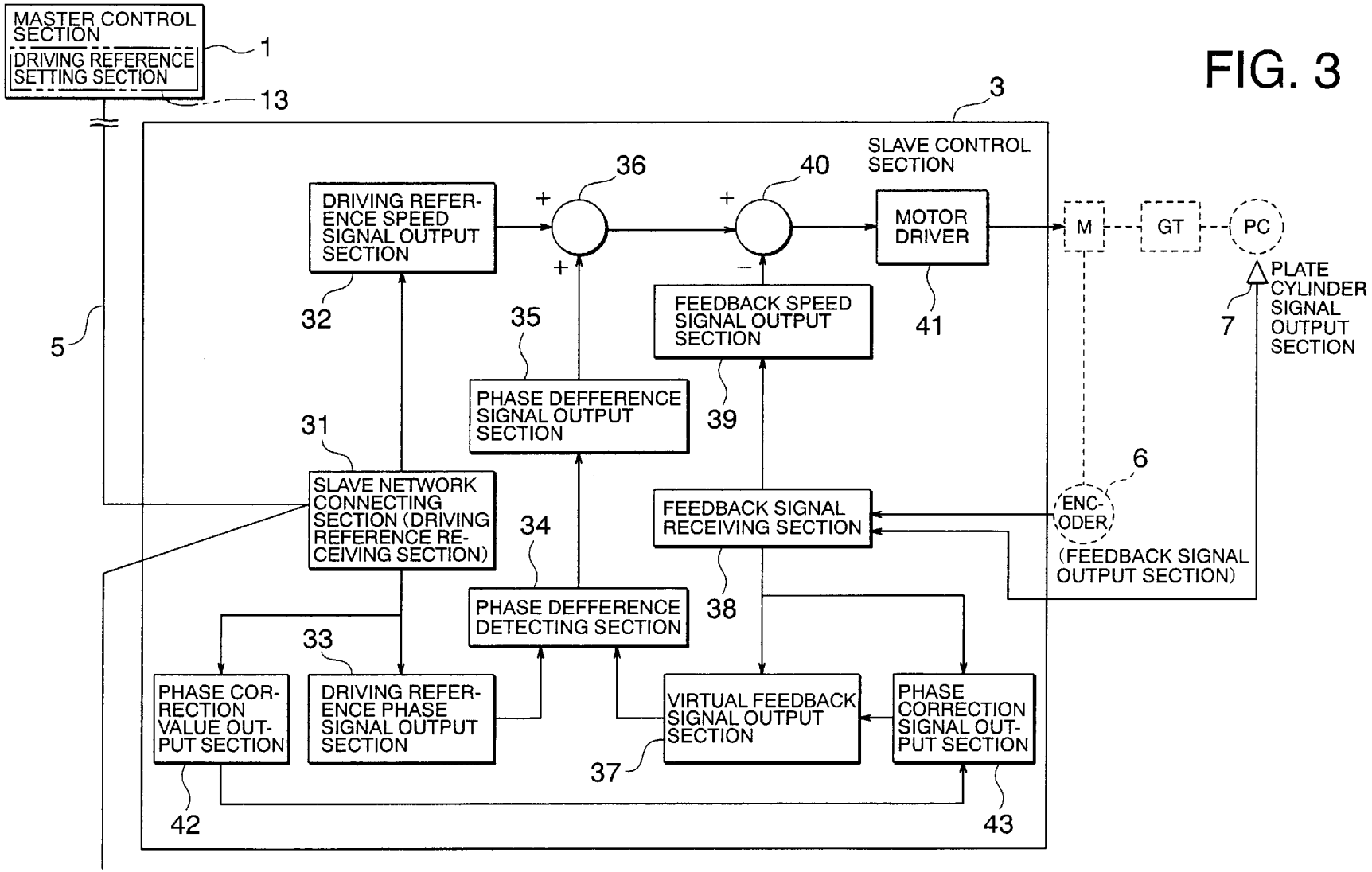
FIG. 3 is a diagram of assistance in explaining a slave control section embodying the present invention.

FIG. 3 is a diagram of assistance in explaining a slave control section. In FIG. 3, the slave control section 3 comprises a slave network connecting section 31 that also serves as a driving reference receiving section, a phase correction value output section 42, a driving reference speed signal output section 32, a driving reference phase signal output section 33, a feedback signal receiving section 38, a phase correction signal output section 43, a feedback speed signal output section 39, a virtual feedback phase signal output section 37, a phase difference detecting section 34, a phase difference signal output section 35, a first speed signal correction section 36, a second speed signal correction section 40, and a motor driver 41.

The slave network connecting section 31 is a microcomputer including an interface, which receives a control range designation message consisting of the set organization information transmitted by the master control section 1, a driving reference comprising a driving reference speed and a driving reference phase, a control message, such as a phase correction value for correcting the rotational phase of the driving means M for a plate cylinder to obtain a matched printing image via the network line 5, and transmits as necessary to the master control section 1 a response message for acknowledging the receipt of a message from the master control section 1 via the network line 5.

The phase correction value output section 42 registers a phase correction value in the control message received by the slave network connecting section 31, and outputs it to the phase correction signal output section 43.

The driving reference speed signal output section 32 converts the driving reference speed in the control message into a driving reference speed signal, which is an analog signal proportional to the speed value entered by the input operation section 11 and set by the processing section 12, and outputs it.

The driving reference phase signal output section 33 receives a driving reference phase of the control message, and outputs it in the form of an appropriate signal every time the driving reference phase is received.

The feedback signal receiving section 38 receives a plate cylinder signal generated by the plate signal output section 7 for the plate cylinder corresponding to the driving means M, and a pulse signal and Z-phase pulse signal output by the encoder 6. The feedback speed signal output section 39 calculates a value proportional to the rotational speed of the driving means M based on the pulse signal output by the encoder 6, converts the calculated value into a driving speed signal, which is an analog signal proportional to the rotational speed of the driving means M, and outputs it.

The phase correction signal output section 43 outputs a phase correction signal based on the phase correction value received from the phase correction value output section 42, the plate cylinder signal output by the plate cylinder signal output means 7, and the pulse signal and the Z-phase signal output by the encoder 6. The virtual feedback phase signal output section 37 detects the virtual feedback phase of the driving means M from the pulse signal output by the encoder 6 and the phase correction signal output by the phase correction signal output section by associating with the rotational phase of the plate cylinder PC, and outputs it in the form of an appropriate signal.

The phase difference detecting section 34 detects the difference between the driving reference phase and the virtual feedback phase of the driving means M from the driving reference phase signal output by the driving reference phase signal output section 33 and the virtual feedback phase signal of the driving means M output by the virtual feedback phase signal output section 37 by associating with the rotational phase of the plate cylinder PC.

The phase difference signal output section 35 is a proportional integration amplifier for converting the difference detected by the phase difference detecting section 34 into an analog phase difference signal and outputting it.

The first speed signal correction section 36 corrects the driving reference speed signal output by the driving reference speed signal output section 32 with the phase difference signal output by the phase difference signal output section 35. The second speed signal correction section 40 corrects the first corrected speed signal corrected by the first speed signal correction section 36 with the feedback speed signal of the driving means M output by the feedback speed signal output section 39.

The motor driver 41 supplies drive power to the driving means M based on the second corrected speed signal corrected by the second speed signal correction section 40.

(4) Synchronous Control of Rotary Press

In the following, control with the synchronous control system for rotary presses according to the present invention will be described.

① Setting of Set Organization

Prior to the printing operation of a rotary press, a phase correction value is input from the input operation section 11 of the master control section 1 to each plate cylinder PC of the printing units CT1, CT2, CT3, CT4, and CT5 and stored in the memory section 18. This phase correction value is obtained by using an appropriate reference, that is, using as the reference a cutting position of a web W on the folding unit FD, for example, examining in advance a shaft between the rotational phase needed to obtain a printing image matching with this cutting position on the web W and the rotational phase of the plate cylinder PC in the normal state, replacing this shift with the amount of rotation of the driving means M, and reducing the amount of rotation of the driving means M into a value converted into the number of pulse signals of the encoder 6.

Next, set organization information for designating printing units and folding units to be synchronously controlled by the master control section 1 during printing operation is input from the input operation section 11 of the master control section 1. The set organization information for designating the printing units CT1, CT2, CT3, CT4, CT5, and the folding unit FD shown in FIG. 1, for example, is input into the master control section 1.

With this input, the processing section 12 of the master control section 1 transmits a control range designation message consisting of ASCII codes to the slave control sections 3 (#11~#18, #21~#28, #31~#38, #41~#48), via the master network connecting section 17 and the network line 5.

(Control Range Designation Message)

Figure 4:
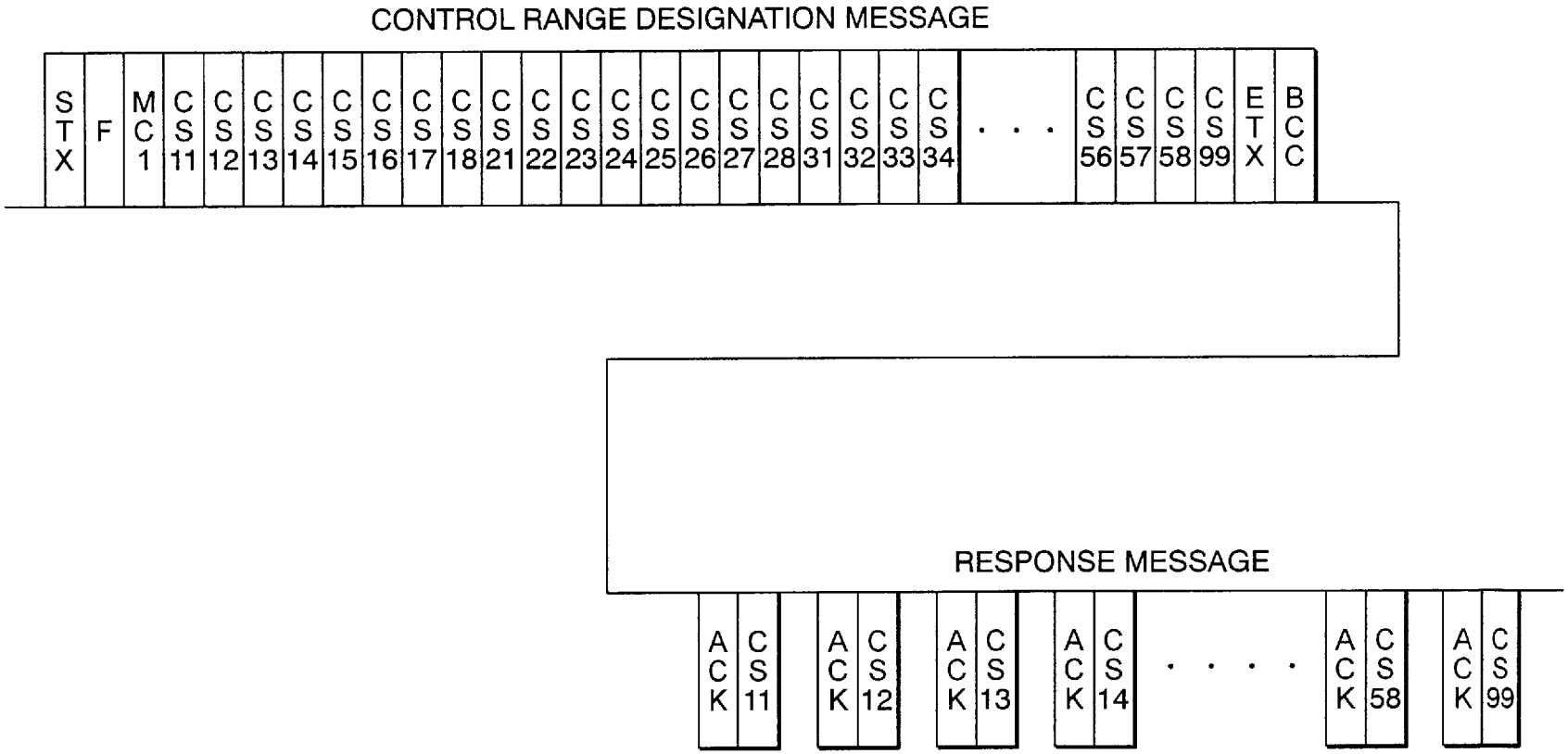
FIG. 4 is a diagram of assistance in explaining a control range designation message and a response message in an embodiment of the present invention.

FIG. 4 is a diagram of assistance in explaining a control range designation message and a response message to it. The control range designation message has a text sentence in which "F" denoting that the message is for designating a control range, "MCI" denoting the master control section 1, and "CS11" through "CS58" and "CS99" denoting the node numbers of the slave control sections 3 (#11~#18, #21~#28, #31~#38, #41~#48, #51~#58, and #99) for the printing couples that are included in the control range are inserted between a start code "STX" and an end code "ETX" of the message; the text sentence followed by a block check "BCC," as shown in FIG. 4.

Upon receipt of a control range designation message, each of the slave control sections 3 transmits a response message acknowledging the receipt of the control range designation message to the master control section 1 via the network line 5. The response messages comprises "ACK" denoting that it is a response message, and its own code number indicating the responded slave control section 3.

Next, the processing section 12 reads the aforementioned phase correction value for the plate cylinders PC of the printing units CT1, CT2, CT3, CT4, and CT5 that receive the control range designation message, convertes the read value into a control message comprising ASCII codes, and transmits it to the slave control sections 3 (#11~#18, #21~#28, #31~#38, #41~#48 and #51~#58) of the printing units CT1, CT2, CT3, CT4 and CT5 via the master network connecting section 17 and the network line 5. The control message is transmitted sequentially to each of the slave control sections 3 while receiving response messages from the slave control sections 3.

(Control Message)

Figure 5:
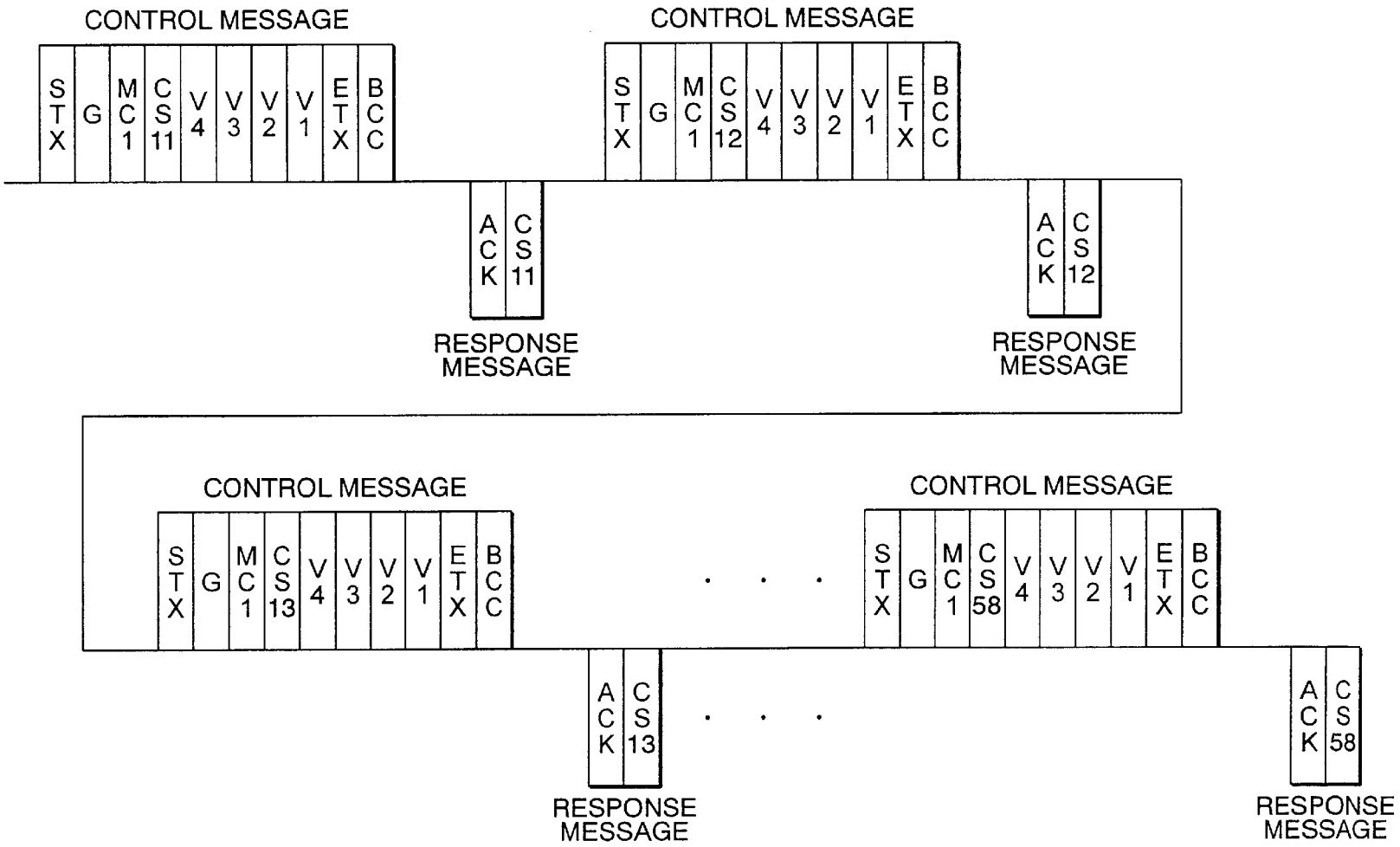
FIG. 5 is a diagram of assistance in explaining a phase correction value control message and a response message in an embodiment of the present invention.

FIG. 5 is a diagram of assistance in explaining a control message and response message for a phase correction value. The control message has a text sentence in which "G" denoting that the message is a phase correction value, "MC1" denoting the master control section 1, any of "CS11"~"CS18," "CS21"~"CS28," "CS31"~"CS38," "CS41"~"CS48," and "CS51"~"CS58" denoting destinations, and "V4," "V3," "V2," and "V1" denoting the phase correction values are inserted between a start code "STX" and an end code "ETX" of the message; the text sentence followed by a block check "BCC". Note that "V4" through "V1" use ASCII codes "0" to "9," and "A" to "F", and the phase correction value comprises four bytes, for example, in the message shown as an example. The phase correction values transmitted to the destinations "CS11"~"CS18," "CS21"~"CS28," "CS31"~"CS38," "CS41"~"CS48," and "CS51"~"CS58" are usually different from each other.

Each of the slave control sections 3, to which a control message of phase correction value was transmitted, returns a response message acknowledging the receipt of the control message comprising a phase correction value to master control section 1 via the slave network connecting section 31 thereof and the network line 5. The response message comprises "ACK" denoting that it is a response message, and its own node number denoting the responded slave control section 3. The exchange of the control message and the response message is sequentially carried out for each slave control section 3.

The phase correction value sent to the salve control section 3 is registered from the slave network connecting section 31 in the phase correction value output section 42. In this description, the phase correction value is not sent to the slave control section 3 (#99) of the folding unit FD since the cutting position by the folding unit FD is used as a reference, and "0" is set and registered in the phase correction value output section 42. The phase correction value registered in the phase correction value output section 42 is entered into the phase correction signal output section 43. The phase correction signal output section 43 is a counter that calculates a value by the following equation using a phase correction value Xn and the total number Ye of the pulse signal output for one turn of the encoder 6, and sets it as a value to be counted.

$$k \times Ye - Xn \text{ (where } k=1, 2, 3, \text{- - - } N).$$

For the slave control section 3 to which no phase correction value is sent the value to be counted that is set by the phase correction signal output section 43 is 0.

After these settings have been completed, synchronous control of the set-organized rotary press by the master control section 1 is enabled.

② Synchronous Control Operation

Synchronous control operation is carried out first by changing over the input operation section 11 of the master control section 1 to the operation signal input enabled state and inputting operation signals, such as start, acceleration/deceleration, and stop, from the input operation section 11.

As operation signals are input, the processing section 12 sets a speed value corresponding to the entered operation signals in the master pulse signal output section 14 of the driving reference setting section 13. With this, the master pulse signal output section 14 outputs a second master pulse signal every time a predetermined number of the first master pulse signals are output. The first and second master pulse signals are those having frequencies equal to those of the pulse signal output by encoder, set corresponding to the driving means M, and the Z-phase pulse signal output by the encoder 6 when the rotary press is operated at a set speed.

As the master pulse signal output section 14 begins outputting the aforementioned signals, the speed setting section 15 and the phase setting section 16 of the driving reference setting section 13 integrate the pulse signals output by the master pulse signal output section 14. That is, the speed setting section 15 integrates the first master pulse signals, and is cleared by the second master pulse signal. The phase setting section 16 integrates the first and second master pulse signals, and the integrated value of the first master pulse signals is cleared by the second master pulse signal, while the integrated value of the second master pulse signals is cleared every time the integrated value amounts to a predetermined value.

The predetermined value at which the second master pulse signal is cleared is predetermined based on the ratio of the revolution of the plate cylinder PC to that of the driving means M. It is "four," for example, when the driving means M rotates four turns for one turn of the plate cylinder PC, and "two" when the driving means M rotates two turns for one turn of the plate cylinder PC.

The integrated value of the speed setting section 15 and the phase setting section 16 are transmitted as a control message at intervals of a predetermined time, 100 microseconds, for example, from the master network connecting section 17 to the salve control sections included in the control range via the network line 5.

(Control Message on the Integrated Values of the Speed and Phase Setting Sections 15 and 16)

Figure 6:
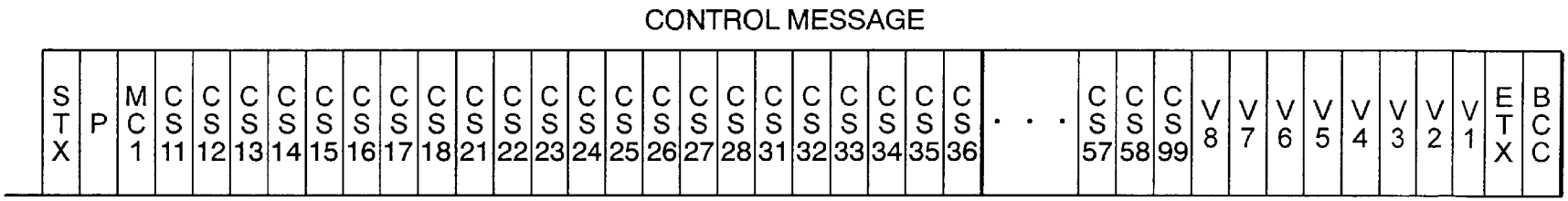
FIG. 6 is a diagram of assistance in explaining an integrated value control message for a speed setting section and a phase setting section in an embodiment of the present invention.

FIG. 6 is a diagram of assistance in explaining a control message on the integrated values of the speed and phase setting sections. A control message, for example, has a text sentence in which "P" denoting that this message is a driving reference, "MC1" denoting the master control section 1, "CS11"~"CS18," "CS21"~"CS28," "CS31"~"CS38," "CS41"~"CS48," "CS51"~"CS58," and "99" denoting the node numbers of the slave control section 3 (#11~#18, #21~#28, #31~#38, #41~#48 and #51~#58, #99) of the printing couples and folding unit FD of the printing units that are included in the control range, CT1, CT2, CT3, CT4 and CT5 "V8," "V7," "V6," and "V5" denoting the driving reference speed and "V4," "V3," "V2," and "V1" denoting the driving reference phase are inserted between a start code "STX" and an end code "ETX" of the message; the text sentence followed by a block check "BCC". Note that "V8" through "V1" use ASCII codes "0" to "9," and "A" to "F", and the driving reference speed and phase comprise four bytes, for example, in the message shown as an example.

These messages are transmitted on the network line 5 at the speed of 20 megabits per second, for example.

③ Slave Control Section (Processing of Driving Reference Speed Signal Output Section 32 and Driving Reference Phase Signal Output Section 33)

In the slave control section 3 where a control message is received, the driving reference speed is input in the driving reference speed signal output section 32, and the driving reference phase is input in the driving reference phase signal output section 33 for further processing. In the driving reference speed signal output section 32 in which the driving reference speed is input, a value S1 proportional to the speed value set by the processing section 12 is calculated using the following equation where the currently input driving reference speed is set as Y2, the driving reference speed input immediately before it as Y1, and the predetermined time interval at which the master control section 1 sends the control message as T, and an analog signal corresponding to this value S1 is output as a driving reference speed signal.

$$S1=(Y2-Y1)/T.$$

As the integrated value of the first master pulse signals of the speed setting section 15 is reset by.the second master pulse signal, it may often happen that Y1>Y2, and as a result, S1<0. In such a case, S1 is calculated using the following equation.

$$S1=(Ym+Y2-Y1)/T.$$

where Ym is the number of outputs of the first master pulse signals needed for the second master pulse signal to be output, which is a predetermined value.

In the driving reference phase signal output section 33 into which the driving reference phases are input, the immediately preceding driving reference phase is replaced with a newly input driving reference phase every time the new driving reference phase is input, and the latest driving reference phase is output in the form of appropriate signals.

Aside from this, a plate cylinder signal output by the plate cylinder signal output section 7 for the plate cylinder PC driven by the driving means M corresponding to each slave control section 3, and the output pulse signals (a pulse signal and Z-phase pulse signal) of the encoder 6 connected to that driving means M are input into the feedback signal receiving section 38, and the encoder output pulse signal is further processed in the following manner in the phase correction signal output section 43, the virtual feedback phase signal output section 37, and the feedback speed signal output section 39.

(Processing in the Phase Correction Signal Output Section 43)

The phase correction signal output section 43 sets in itself, as a value being counted, a value k×Ye−Xn (where k=1, 2, 3, - - - *N*) obtained by deducting the phase correction value input by the phase correction value output section 42, as mentioned above, from the total number of pulse signals output by the encoder 6 as it rotates k turns, starts counting the number of pulse signals output by the encoder 6 upon receipt of a first Z-phase pulse signal output by the encoder 6 after the plate cylinder signal output section 7 has output the plate cylinder signal, and outputs a phase correction signal every time the counting of the pulse signals is completed by the number expressed by the following equation.

$$k\times Ye-Xn \text{ (where } k=1, 2, 3, - - - N).$$

In other words, the phase correction signal output section 43 outputs a phase correction signal obtained by delaying the Z-phase pulse signal output by the encoder 6 after the plate cylinder signal has been output by the number of pulse signals (Ye−Xn) output by the encoder 6 (to put it another way, a phase correction signal obtained by advancing the Z-phase pulse signal output by the encoder 6 after the plate cylinder signal has been output by the number of pulse number (Xn) output by the encoder 6). Where the number being counted is "0," the output timing of the phase correction signal agrees with the output timing of the Z-phase pulse signal by the encoder 6 in the slave control section 3.

Since the plate cylinder signal output by the plate cylinder signal output section 7 is for preventing a phase shift at the start of control between the plate cylinders PC caused by the difference between one turn of the plate cylinder and N turns of the driving means M, similar synchronous control can be accomplished by making only the latest plate cylinder signal after the start of control valid while making the other plate cylinder signals invalid. In this case, however, the value set as the value being counted by the phase correction signal output section 43 for itself should be a value (Ye−Xn) obtained by deducting the phase correction value Xn from the total number Ye of the pulse signals output by the encoder 6 as the encoder 6 rotates one turn, the counting of the pulse signals output by the encoder 6 should be started when the first Z-phase pulse signal output by the encoder 6 is input after the latest plate cylinder has been output by the plate cylinder signal output section 7, so that a phase correction signal is output at the time when the pulse signals has been counted by the aforementioned set number (Ye−Xn), and thereafter the phase correction signal output section 43 counts the pulse signal output by the encoder 6 every time the Z-phase pulse signal is input, and outputs a phase correction signal when the counting reaches (Ye−Xn).

In this case, moreover, the integrated value of the phase correction signals, which will be described later, is cleared every time the integrated value of the phase correction signals reaches a predetermined number. The predetermined number at which the integrated value of the phase correction signals is cleared is determined based on the ratio of the revolution of the plate cylinder PC to the revolution of the driving means M, as in the case where the integrated value of the second master pulse signals is cleared in the phase setting section 16, as described earlier. That is, when the driving means M rotates four turns for one turn of the plate cylinder PC, the aforementioned predetermined number is "4," and when the driving means M rotates two turns for one turn of the plate cylinder PC, the predetermined number is "2." In this way, in a control mode where only the latest plate cylinder signal is valid, it is not necessary to input any plate cylinder signals in the virtual feedback phase signal output section 37.

(Processing in the Virtual Feedback Phase Signal Output Section 37)

The virtual feedback phase signal output section 37 integrates the pulse signals output by the encoder 6 and the phase correction signals output by the phase correction signal output section 43, and outputs the integrated values in the form of appropriate signals as a rotational phase value for the driving means. During integration by the virtual feedback phase signal output section 37, the integrated value of pulse signals is cleared by a phase correction signal, and the integrated value of the phase correction signals is cleared by the first phase correction signal output by the phase correction signal output section 43 after the plate cylinder signal output section 7 has output a plate cylinder signal.

(Processing in the Feedback Speed Signal Output Section 39)

The feedback speed signal output section 39 integrates the pulse signals output by the encoder 6, calculates a value S2 proportional to the rotational speed of the driving means M using the following equation where the integrated value obtained every time the slave network connecting section 31 receives a control message is set as Y4, the integrated value at the time when the immediately preceding control message is received as Y3, and the predetermined time interval at which the master control section 1 transmits control messages as T, and outputs an analog signal corresponding to this value S2 as a driving speed signal.

$$S2=(Y4-Y3)/T.$$

There can be a case where Y3>Y4 and accordingly S2<0 when the integrated value of the pulse signals on the feedback speed signal output section 39 are reset by the Z-phase pulse signal. In such a case, S2 is calculated using the following equation.

$$S2=(Ye+Y4-Y3)/T$$

where Ye is the total number of pulse signals output as the encoder 6 rotates one turn, that is, the number of pulse signal outputs generated by the encoder 6 during the period when the preceding and succeeding two Z-phase pulse signals are output, or a predetermined value of the same number as the number of outputs Ym of the first master pulse signals needed for the second master pulse signals to be output.

(Correction of Drive Power for the Driving Means M by the Motor Driver 41)

In the slave control section 3, drive power for the driving means M is corrected by the motor driver 41 every time the slave network connecting section 31 receives a control message. The details are as follows:

The driving reference phase signal output section 33 outputs a driving reference phase signal every time the slave network connecting section 31 receives a control message, as described above. The driving reference phase signal is input into the phase difference detecting section 34. A virtual feedback phase obtained by correcting the actual rotational phase of the driving means M with a phase correction value is input into the phase difference detecting section 34 by the virtual feedback phase signal output by the virtual feedback phase signal output section 37.

The phase difference detecting section 34 calculates a difference between the driving reference phase and the virtual feedback phase of the driving means M based on the driving reference phase signal and the virtual feedback phase signal every time a driving reference phase signal is input, and outputs the calculated difference into the phase difference signal output section 35 that is an integration amplifier. With this, the phase difference signal output section 35 outputs an analog signal corresponding to the difference as a phase difference signal.

The driving reference speed signal is corrected in a first speed signal correcting section 36 into a first corrected speed signal, and then further corrected by the feedback speed signal in a second speed signal correcting section 40 into a second corrected speed signal, which is input into a motor driver 41.

The motor driver 41 into which the second corrected speed signal is input corrects the drive power being supplied to the driving means M so as to match with the second corrected speed signal.

As described above, in a rotary press having a plurality of printing mechanisms that rotate N turns (N being a natural number) for one turn of the plate cylinder, so that printing images are printed on a paper web W passing sequentially on the printing mechanisms, this embodiment prevents the phase shift at the start of control between plate cylinders PC caused by the difference between the plate cylinders that rotate one turn and the driving means M rotating N turns. The embodiment also achieves synchronous rotation of the plate cylinders driven by the driving means M at a rotational phase to obtain matched printing images by using an adequate reference, by using as a reference the cutting position of the web W by the folding unit FD, measuring in advance the shift of the rotational phase of the plate cylinder PC in the normal state with respect to the rotational phase to obtain a printing image matching with the cutting position on a paper web W, replacing the phase shift with the amount of rotation of the driving means M, setting as a phase correction value a value obtained by modifying the amount of rotation into the number of pulse signals of the encoder 6, obtaining a virtual feedback phase by correcting the actual rotational phase of the driving means for driving the plate cylinders PC, and carrying out synchronous control so as to match the virtual feedback phase with the driving reference phase.

As described above, this embodiment can accomplish with high precision the synchronous control of driving means for printing mechanisms in which the plate cylinders rotate 1/N turns (N being a natural number) for one turn of the driving means while preventing phase shifts at the start of control between the plate cylinders PC due to the difference in rotation between the plate cylinder and the driving means M. The embodiment can quickly stabilize the synchronous rotation of the driving means. These effects work synergistically to bring about the stabilized rotation of plate cylinders, reducing spoilage, such as defective printing due to shifts in the rotational phase of the plate cylinders.

As described above, the present invention has the following effects.

The present invention prevents phase shifts at the start of control between the plate cylinders based on a difference of the plate cylinder rotating one turn and the driving means rotating N turns to synchronize the rotation of the plate cylinders, and accomplishes the synchronous control of driving means with high precision, quickly stabilizes the synchronous rotation of the driving means by replacing the rotational phase of a particular plate cylinder for matching a printing image with a predetermined reference with the rotational phase of the driving means corresponding to that rotational phase, converting a shift between the rotational phase of the driving means for matching and the rotational phase of the driving means in the normal state, that is, a difference in rotation between the driving means into the number of outputs of first pulse signals and sets it as a correction value, operating the driving reference setting section to output a driving reference comprising a reference speed and a reference phase, causing the driving means to start rotation at the reference speed, outputting a first pulse signal proportional the amount of angular displacement of the driving means and a second pulse signal for one turn of the driving means, causing the plate cylinder signal output section to output a plate cylinder signal for one turn of the plate cylinder driven by the driving means, and causing the control section to exercise control so as to shift the rotational phase of each driving means by the amount of the correction value to have a virtual feedback phase based on the first pulse signal, the second pulse signal and the plate cylinder signal, and to synchronize the driving reference phase with the virtual feedback phase of each driving means. These effects work synergistically to stabilize the rotation of the plate cylinders, helping reduce spoilage, such as defective printing, due to shifts in the rotational phase of plate cylinders.

What is claimed is:

1. A synchronous control system for a rotary press having a plurality of printing mechanisms driven by individual driving means that rotate an integer number of turns for one turn of a plate cylinder associated with each driving means, and a control section for controlling each driving means, so that printing images can be printed on a paper web sequentially passing through the printing mechanisms in such a manner as to match with a predetermined reference, characterized in that the synchronous control system comprises a plate cylinder signal output section for outputting a plate cylinder signal for one turn of each plate cylinder, a feedback signal output section for outputting a first pulse signal proportional to the amount of angular displacement along with the rotation of each driving means, and a second pulse signal for one turn of each driving means, and a driving reference setting section for setting a driving reference comprising a reference speed and a reference phase;

the control section exercising control so as to replace the rotational phase of one of said plate cylinders for matching a printing image with a predetermined reference with the rotational phase of a driving means corresponding to the rotational phase of the one plate cylinder, convert a shift between the rotational phase of the driving means for matching and the rotational phase of the driving means in a normal state into the number of outputs of the first pulse signal that is set as a correction value, shift the rotational phase of each driving means by the amount of the correction value to produce a virtual feedback phase, and synchronize the driving reference phase with the virtual feedback phase of each driving means.

2. A synchronous control system for a rotary press having, a plurality of printing mechanisms driven by individual driving means that rotate an integer number of turns for one turn of a plate cylinder associated with each driving means and a control section for controlling the driving means, so that printing images can be printed on a paper web sequentially passing through the printing mechanisms in such a manner as to match with a predetermined reference, characterized in that the synchronous control system comprises a plate cylinder signal output section for outputting a plate cylinder signal for one turn of each plate cylinder a feedback signal output section for outputting a first pulse signal proportional to the amount of angular displacement along with the rotation of each driving means, and a second pulse signal for one turn of each driving means, and a driving reference setting section for setting a driving reference comprising a reference speed and a reference phase;

the control section comprising a phase correction value output section for outputting a phase correction value for correcting a feedback phase of each driving means a driving reference speed signal output section for outputting a driving reference speed signal and a driving reference phase signal both based on a driving reference given by the driving reference setting section, a feedback speed signal output section for outputting a feedback speed signal for each driving means based on the first pulse signal and a virtual feedback phase signal output section for outputting a virtual feedback rotational phase signal obtained by correcting the feedback phase of each driving means based on the first pulse signal, the second pulse signal and the plate cylinder signal with the phase correction value; and the control section generating a control signal obtained by correcting the driving reference speed signal with a signal relating to a difference between the driving reference phase and the virtual feedback rotational phase and the feedback speed signal, and controlling the operation of the printing mechanisms with the control signal.

3. A synchronous control system for a rotary press having a plurality of printing mechanisms driven by individual driving means that rotate an integer number of turns for one turn of a plate cylinder associated with each driving means, and a control section for controlling each driving means, so that printing images can be printed on a paper web sequentially passing through the printing mechanisms in such a manner as to match with a predetermined reference, characterized in that the synchronous control system comprises a plate cylinder signal output section for outputting a plate cylinder signal for one turn of each plate cylinder, a feedback signal output section for outputting a first pulse signal proportional to the amount of angular displacement along with the rotation of each driving means, and a second pulse signal for one turn of each driving means, and a driving reference setting section for setting the driving reference comprising a reference speed and a reference phase;

the control section comprising, a driving reference receiving section for receiving the driving reference, a driving reference speed signal output section for outputting a signal relating to the driving reference speed based on the driving reference received by the driving reference receiving section, a driving reference phase signal output section for outputting a signal relating to the driving reference phase based on the driving reference received by the driving reference receiving section, a feedback signal receiving section for receiving an output signal from the feedback signal output section and an output signal from the plate cylinder signal output section, a feedback speed signal output section for outputting a signal relating to a feedback speed of each driving means based on the first pulse signal received by the feedback signal receiving section, a phase correction signal output section for outputting a phase correction signal for correcting a feedback phase of each driving means based on the first pulse signal, the second pulse signal and the plate cylinder signal received by the feedback signal receiving section, a feedback phase signal output section for outputting a virtual feedback phase signal obtained by correcting the feedback phase with the phase correction signal, a phase difference detecting section for detecting a phase difference between the driving reference phase signal and the virtual feedback phase signal, a phase difference signal output section for outputting a signal relating to the phase difference detected by the phase difference detecting section, and a signal correcting section for correcting the driving reference speed signal based on the output of the phase difference signal output section and the output of the feedback speed signal output section to generate a correction control signal;

the control section controlling the printing mechanism driving means via a motor driver with the correction control signal output by the signal correcting section.

4. A synchronous control system for a rotary press set forth in claim 1 wherein the feedback signal output section is an incremental encoder with Z-phase that serves as a detecting means for outputting a signal as the plate cylinder signal output section detects a predetermined part being inspected for one turn of the plate cylinder.

5. A synchronous control system for a rotary press set forth in claim 1 wherein the control section is a slave control section subordinated to a master control section; the master control section being adapted so as to set and transmit the driving reference including the driving reference speed and the driving reference phase.

6. A synchronous control system for a rotary press set forth in claim 5 wherein the master control section and the slave control section are each connected to a network line.

7. A synchronous control system for a rotary press set forth in claim 5 wherein the master control section comprises an input processing section for inputting information needed to operate the rotary press and others;

a processing section for processing information input from the input processing section to operate other component sections, and controlling the exchange of signals with the slave control section, a memory section for storing a value for correcting the feedback phase, and the driving reference setting section for setting the driving reference phase and a driving reference speed.

8. A synchronous control system for a rotary press set forth in claim 7 wherein the driving reference setting section comprises a master pulse signal output section for outputting a first master pulse signal corresponding to a third pulse signal and a second master pulse signal corresponding to a fourth pulse signal every time a predetermined number of the first master pulse signal have been output, a speed setting section for setting a driving reference speed based on the first master pulse signal, and a phase setting section for setting a driving reference phase based on the first master pulse signal and the second master pulse signal.

9. A synchronous control system for a rotary press set forth in claim 2 wherein the feedback signal output section is an incremental encoder with Z-phase that serves as a detecting means for outputting a signal as the plate cylinder signal output section detects a predetermined part being inspected for one turn of the plate cylinder.

10. A synchronous control system for a rotary press set forth in claim 3 wherein the feedback signal output section is an incremental encoder with Z-phase that serves as a detecting means for outputting a signal as the plate cylinder signal output section detects a predetermined part being inspected for one turn of the plate cylinder.

11. A synchronous control system for a rotary press set forth in claim 2 wherein the control section is a slave control section subordinated to a master control section; the master control section being adapted so as to set and transmit the driving reference including a driving reference speed and the driving reference phase.

12. A synchronous control system for a rotary press set forth in claim 3 wherein the control section is a slave control section subordinated to a master control section; the master control section being adapted so as to set and transmit the driving reference including the driving reference speed and the driving reference phase.

13. A synchronous control system for a rotary press set forth in claim 4 wherein the control section is a slave control section subordinated to a master control section; the master control section being adapted so as to set and transmit the driving reference including the driving reference speed and the driving reference phase.

14. A synchronous control system for a rotary press set forth in claim 6 wherein the master control section comprises an input processing section for inputting information needed to operate the rotary press and others;

a processing section for processing information in put from the input processing section to operate other component sections, and controlling the exchange of signals with the slave control section, a memory section for storing a value for correcting the feedback phase, and the driving reference setting section for setting the driving reference phase and the driving reference speed.

* * * * *